US008585447B2

(12) United States Patent
Drew et al.

(10) Patent No.: US 8,585,447 B2
(45) Date of Patent: Nov. 19, 2013

(54) ELECTRICALLY-CONDUCTING CONTACT ELEMENT WITH AN APERTURE WITH AN INTERNAL SURFACE HAVING A GROOVE WITH SHARP EDGES

(75) Inventors: George Albert Drew, Warren, OH (US); Eric B. Poma, Hubbard, OH (US); William J. Palm, Warren, OH (US); Kurt P. Seifert, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/421,932

(22) Filed: Mar. 16, 2012

(65) Prior Publication Data

US 2013/0045610 A1 Feb. 21, 2013

Related U.S. Application Data

(60) Provisional application No. 61/524,557, filed on Aug. 17, 2011.

(51) Int. Cl.
*H01R 13/187* (2006.01)

(52) U.S. Cl.
USPC ..... 439/843

(58) Field of Classification Search
USPC ..... 439/761, 803, 843, 877
See application file for complete search history.

(56) References Cited

U.S. PATENT DOCUMENTS

| | | | | |
|---|---|---|---|---|
| 2,008,227 | A * | 7/1935 | Reilly | 403/284 |
| 2,320,543 | A * | 6/1943 | Doughty | 403/370 |
| 3,852,850 | A * | 12/1974 | Filhaber | 24/136 R |
| 5,369,849 | A * | 12/1994 | De France | 24/136 R |
| 6,899,571 | B1 * | 5/2005 | Koch et al. | 439/843 |
| 7,393,214 | B2 | 7/2008 | DiStefano | |
| 7,597,596 | B2 * | 10/2009 | Watanabe | 439/877 |
| 7,666,012 | B2 * | 2/2010 | Hughes et al. | 439/181 |
| 7,837,476 | B2 | 11/2010 | DiStefano | |
| 7,862,354 | B2 * | 1/2011 | Hughes et al. | 439/181 |
| 8,052,492 | B2 | 11/2011 | Drew et al. | |

* cited by examiner

*Primary Examiner* — Chandrika Prasad
(74) *Attorney, Agent, or Firm* — Robert J. Myers

(57) ABSTRACT

An electrically-conducting contact element includes a section of the contact element defining an aperture. The section is configured to receive a wire cable within the aperture for attachment thereto. The section includes an internal surface with at least one groove having sharp edges formed therein. A wire assembly that includes the electrically-conducting contact and a method to construct the electrically-conducting contact are also presented. The method includes a step of providing the contact element and forming at least one cutout groove on the internal surface of the contact element. A further step in the method includes altering material on the internal surface of the contact element by a forming means. The forming means may be one of milling, rifling, machining, cutting, indenting, or stamping. A wire assembly and a vehicular electrical wiring harness that respectively include the contact element are also further presented.

11 Claims, 4 Drawing Sheets

ELECTRICALLY-CONDUCTING CONTACT ELEMENT WITH AN APERTURE WITH AN INTERNAL SURFACE HAVING A GROOVE WITH SHARP EDGES

CROSS-REFERENCE TO RELATED APPLICATION

This application claims priority to provisional application U.S. Ser. No. 61/524,557 filed on Aug. 17, 2011.

TECHNICAL FIELD OF THE INVENTION

The invention relates to an electrically-conducting contact element and wiring assemblies and electrical connection systems that employ the contact element.

BACKGROUND OF THE INVENTION

Electrical contacts, or terminals are commonly attached to wire cables by employing a crimp to form a crimp connection. In one such electrical application, a barrel-type terminal is utilized that attaches with an aluminum wire cable. The barrel-type terminal includes a portion defining a hole that receives the wire cable. While typically manufactured in a screw machine, the inner portion of the barrel-type terminal has a smooth internal surface. When the portion of the barrel-type terminal is crimped to an aluminum wire cable, the inner smooth surface of the barrel-type terminal may not engage the aluminum wire cable in a manner that allows breakage of oxides disposed on a lead of the wire cable so that a robust, reliable electrical connection of the aluminum wire cable to the barrel-type terminal is attained. Undesired high resistance crimp connections using these smooth surfaces may result that negatively affect the electrical performance of these crimp connections while a mechanical pull force of the wire cable from the terminal may be undesirably decreased.

What is needed is an electrical contact element that overcomes the foregoing shortcomings while allowing robust attachment of the aluminum wire cable to the terminal.

BRIEF SUMMARY OF THE INVENTION

In accordance with one embodiment of the invention, an electrically-conducting contact element includes a section of the contact element defining an aperture. The section is configured to receive a wire cable in the aperture for attachment thereto. The section further including an internal surface defining at least one groove having sharp edges formed therein.

A method is also presented to construct an electrically-conducting contact element. One step in the method is providing the electrically-conducting contact element that has a section defining an aperture. The section is configured to receive a wire cable in the aperture for attachment thereto. The section further includes an internal surface. Another step in the method is forming at least one groove on the internal surface of the section.

A wire assembly and a vehicular electrical wiring harness that respectively include the electrically-conducting contact element are also presented.

Further features, uses and advantages of the invention will appear more clearly on a reading of the following detailed description of the embodiments of the invention, which is given by way of non-limiting example only and with reference to the accompanying drawings.

BRIEF DESCRIPTION OF THE SEVERAL VIEWS OF THE DRAWING

This invention will be further described with reference to the accompanying drawings in which.

DETAILED DESCRIPTION OF THE INVENTION

Electrical wire harnesses may connect one electrical component with another electrical component in an electrical application such as may be found in the motorized vehicle transportation industry. One such wire harness may electrically connect an energy source to a load in an electric or hybrid-electric vehicle. The wire harness may include one or more wire assemblies that may be part of electrical connection system that is associated with the vehicle that electrically connect electrical devices together. Especially when aluminum wire cable is employed, constructing a wire assembly that also assists to break up oxides on a lead of the aluminum wire cable when the wire assembly is constructed is advantageously desired to ensure robust electrical connections.

Figure 1:
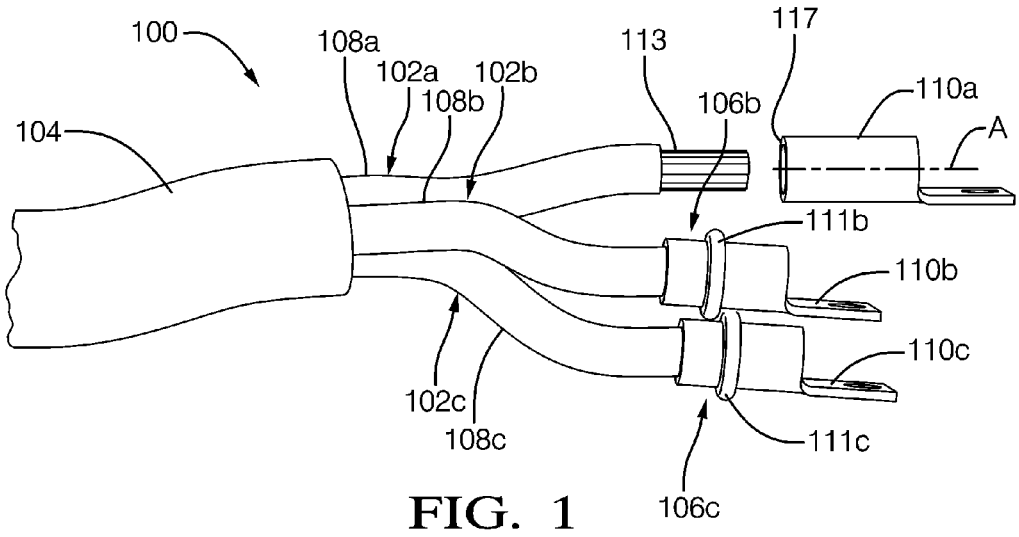
FIG. 1 shows an exploded view of a plurality of wire harness assemblies in accordance to the invention.

Referring to FIG. 1, according to one embodiment of the invention, an exploded view of a wire cable harness 100 is presented. Three electrically-conductive wire conductors, or wire cables 102*a-c* extend from an insulation outer sheath 104 of harness 100. Wire assemblies 106*b-c* respectively contain wire cables 102*b-c* and electrically-conducting contact elements, or terminals 110*b-c* attached thereat. Terminals 110*b-c* are attached to wire cables 102*b-c*, preferably by a crimp connection formed respectively between the wire cable 102 and the terminal 110. These crimp connections may be formed by way of a press as is known in the wiring arts. Wire cables 102*a-c* have a metallic inner core 112 formed by a plurality of individual wire strands. Alternately, the inner metallic core may be formed of a single solid metallic core. While FIG. 1 shows a crimp connection having a raised portion 111*b*, 111*c* along its outer external surface, alternative crimp connections may be formed that have indentions in the external surfaces of the terminals. Wire cable 102*a* is positioned to receive terminal 110*a* along a longitudinal axis A. Terminal 110 is formed of a metal material, such as copper and copper alloy, or brass. Alternately, the terminals may also be coated with at least one electrically-enhancing plating material such as gold, silver, tin, nickel or other plating metal materials for improved electrical and/or mechanical performance of the electrical contact element. For example, nickel may be used in conjunction with one of the other electrically enhancing plating materials. The nickel material may assist to increase the number of engage/disengage cycles of the electrical contact element with a corresponding mating electrical contact element in an electrical connection system while one of the other plating materials may enhance the electrical properties of the electrical contact element. Wire assemblies 106 may electrically connect harness 100 to an energy storage device, battery, or some other electrical component or device. Inner core 112 of wire cables 102*a-c* is surrounded by an insulation outer layer, or covering 108*a-c*. Inner core 112 may be formed from any electrically-conductive material, such as copper and copper alloy or aluminum and aluminum alloy. Alternately, the inner core may be formed of a single solid metal strand of material. Insulation outer coverings 108*a-c*, similar to insulation outer sheath 104, may be formed of a dielectric plastic material. Respective leads 113 of the wire cables 102*a-c* are crimped to the terminals 110*a-c* after leads 113 are received in terminals 110*a-c*. Lead 113 of wire cable 102*a* is also illustrated as being received in a portion of terminal 110*a*.

Figure 2:
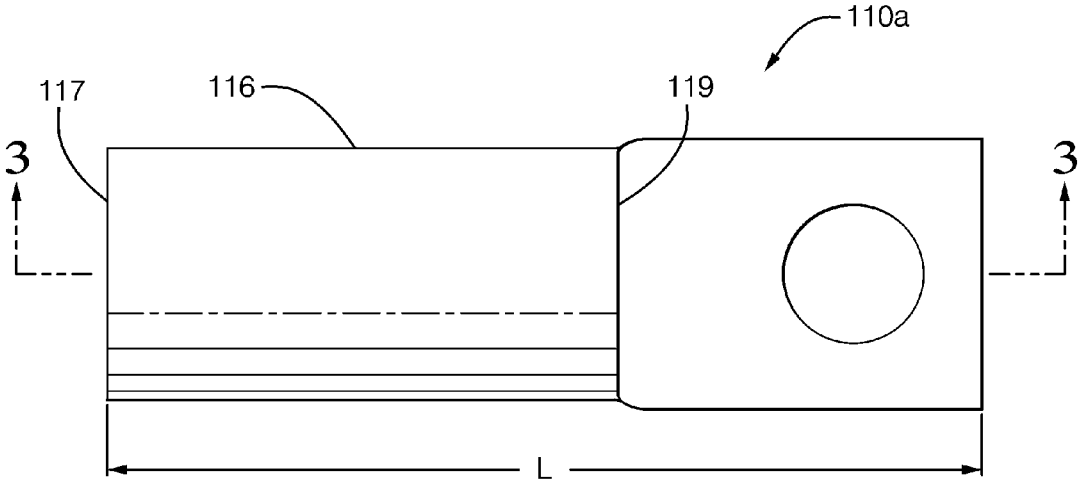
FIG. 2 shows an uncrimped contact element of one of the wire harness assemblies of FIG. 1.

Referring to FIG. 2, an uncrimped terminal 110*a* prior to wire cable 102*a* being received therein is illustrated. Terminal 110*a* has a length L disposed along axis A. Terminal 110*a* includes a barreled or tubular section 116, and thus, terminal 110*a* is generally known as a barrel-type electrical contact. Tubular section 116 includes spaced apart axial ends 117, 119. Tubular section 116 communicates with wire cable 102*a* when lead 113 of wire cable 102*a* is received in tubular section 116 through end 117. A sufficiently sized tubular section is chosen for attachment with a correspondingly sized wire cable to ensure a robust electrical connection. Tubular section 116 is a seamless tubular section. End 117 is configured to receive lead 113 of wire cable 102*a*. Alternately, the tubular section may include a seam which may be formed by soldering, welding, or baizing, as is known in the terminal and wiring arts. Preferably, the seam is an axial seam parallel with axis A. Tubular section 116 defines an aperture 118 therethrough. Still yet alternately, the aperture may have a closed end and the closed end is remote from an end of the tubular section that receives the wire cable. Still yet alternately, the tubular section and corresponding aperture may be some other type of cross-sectional shape that still effectively receives the lead of the wire cable and is effectively crimped to form a reliable mechanical and electrical connection with the terminal without departing from the spirit and scope of the invention. Aperture 118 and tubular section 116 are respectively circular in a cross-section view through tubular section 116 in which the cross section view is in a direction transverse to axis A. An interior, or internal surface 120 of tubular section 116 that surrounds aperture 118 further defines a helical groove, cutout pattern, deformity, or arrangement 122 that surrounds axis A. Alternately, the groove disposed in the internal surface of the tubular section may be formed to have any type of shape. Terminal 110*a* includes a ring-shaped tongue 123 that contains an opening 125 defined therethrough. Tongue 123 axially extends away from tubular section 116. Opening 125 of tongue 123 may be configured to receive a lug disposed in an electrical application where the electrical contact is utilized. Alternately, the tongue of the terminal may be a U-shaped spade tongue or any other shaped tongue required for an electrical application of use.

Figure 3:
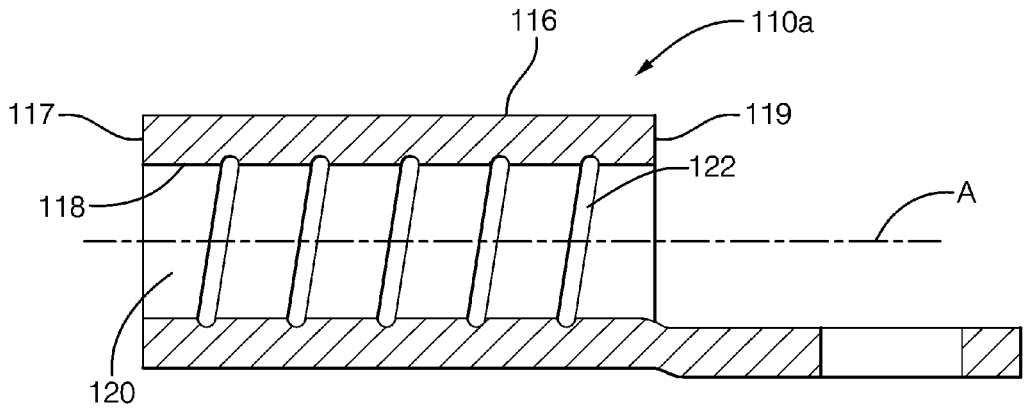
FIG. 3 shows a cross section view of the contact element of FIG. 2 through the lines 3-3, showing helical groove pattern details defined therein.

Turning now to FIG. 3, a cross section of the uncrimped terminal 110*a* of FIG. 2 shows a single, crooked, helical groove 122 defined about axis A in internal surface 120 of terminal 110*a* along a portion of the length L of terminal 110*a*. Crooked as used herein may be defined as having at least one bend of at least one curve while not being completely straight. Alternately, the helical groove pattern may be formed along the entire axial length of the section in the internal surface. In yet another alternative embodiment, the helical groove pattern may be in communication with one or more of the ends of the tubular section. Terminals 110*b-c* are constructed similarly to that of terminal 110*a* as previously described herein and similarly receive additional wire cables.

Figure 4:
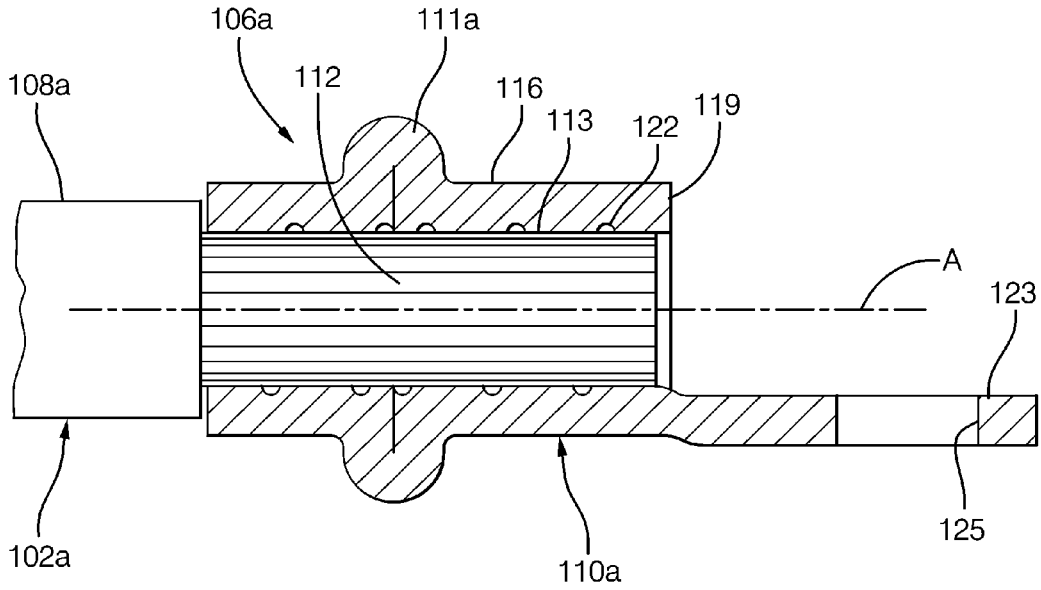
FIG. 4 shows a cross section view of one of the crimped wire harness assemblies of FIG. 1.

Referring to FIG. 4, lead 113 of wire cable 102*a* is illustrated as being crimped to terminal 110*a* to form wire assembly 106*a*. Raised portion 111*a* of crimp is similar to other raised portions 111*b*, 111*c* as previously discussed herein, as best illustrated in FIG. 1. Wire assembly 106*a* is similar to wire assemblies 106*b-c* that are best formerly illustrated in FIG. 1.

Figure 5:
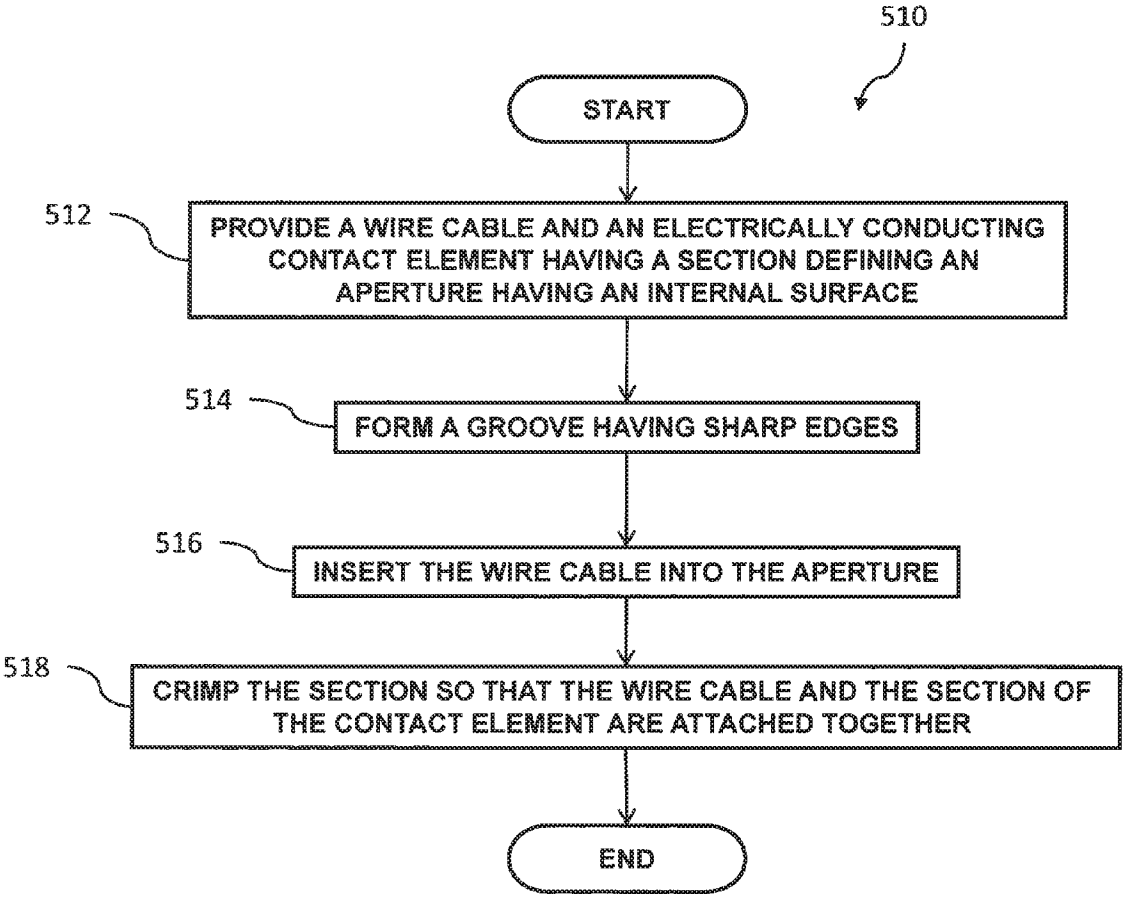
FIG. 5 shows a method flow diagram on how to construct the contact element as illustrated in the embodiment of FIGS. 1-4.

Referring to FIG. 5, a method 510 is presented to construct terminal 110*a* as described in the embodiment of FIGS. 1-4. One step 512 in method 510 is providing the terminal 110*a*. The terminal 110*a* has tubular section 116 defining aperture 118. Tubular section 116 is configured to receive wire cable 102*a* in aperture 118 for attachment thereto. Tubular section 116 includes internal surface 120. Another step 514 in method 510 is forming groove 122 in internal surface 120. Thus, internal surface 120 of terminal 110*a* is altered in some manner to form groove 122. Groove 122 is continuous in that groove 122 extends, or is prolonged without break or irregularity along internal surface 120. Alternately, the groove could be individual non-continuous segments formed in the internal surface. Groove 122 may be formed by removing material from internal surface 120 by a forming means. The forming means may include, but not be limited to removal of the material from internal surface 120 by milling, rifling, machining, or cutting (not shown) to form a groove in internal surface 120. Alternately, if the barrel is formed by being soldered or brazed or welded the groove may be formed on the interior surface by an indenting or a stamping process. The indenting or stamping process displaces material to form the groove in contrast to removal of material as characterized with previously presented processes as described herein. The indenting or stamping processes may be performed with a press as is known in the electrical contact arts.

Preferably, material from internal surface 120 of terminal 110 is generally removed prior to wire assembly 106 being constructed. In another embodiment, the terminal with a smooth internal surface may be initially constructed and the helical screw-thread type groove defined therein using a simple tap. In another embodiment, the helical groove may be manufactured when the terminal is constructed. Since groove 122 is formed or cut out of internal surface 120 of tubular section 116, sharp edges are also formed adjacent internal surface 120 along groove 122. When tubular section 116 is crimped to lead 113 of wire cable 102, inner core 112 engages these sharp edges which advantageously assist to scrape and break up oxides formed on lead 113 of wire cable 102. The material of lead 113 also flows during the crimping process, by being deformed and extruded into the helical groove 122, when the crimp connection is formed. The additional surface area formed by the helical groove by which the individual wire strands of the lead may interlockingly fill during formation of the crimp connection may further enhance the electrical performance at the lead to terminal interface. It has been observed that the helical groove allows the resistance of the crimp connection between the wire cable and the contact element to be less than that of an electrical contact that has a smooth internal surface that does not include the helical groove. Thus, the helical groove advantageously provides for an improved low resistance electrical crimp connection of the wire cable and electrical contact. It has also been observed that this improved, low resistance electrical connection may advantageously be more consistently manufactured. Yet another observation is that the helical groove may provide a stronger mechanical strength at the crimp connection than when using an electrical contact having a smooth internal surface as previously described in the Background of the Invention. The increased mechanical strength is especially prevalent on crimp connections that employ smaller sized wire cables. Wire assemblies 106*a-c* each have similar features and are constructed in a similar manner.

Terminal 110 is not in use when wire cable 102 has not been received in terminal 110.

Terminal 110 is in use when lead 113 of wire cable 102 is received in terminal 110 and wire cable 102 is crimped to terminal 110. Once crimped to terminal 110, an electrical signal carried on wire cable 102 also electrically transmits on terminal 110.

Figure 6:
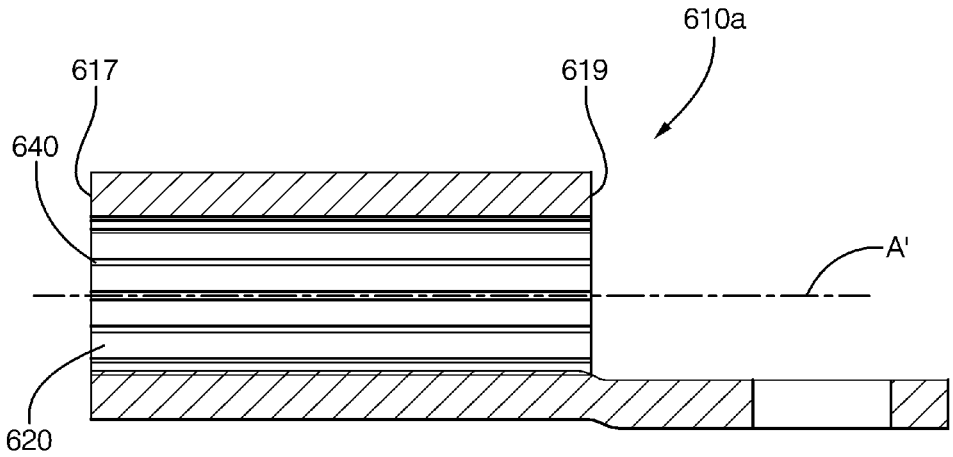
FIG. 6 shows a straight groove pattern defined in a contact element according to an alternate embodiment of the invention.

Referring to FIG. 6, according to an alternate embodiment of the invention, a cross section view of a terminal 610*a* that has a plurality of straight axial grooves 640 defined in internal surface 620 along a longitudinal axis A'. Grooves 640 are defined in internal surface 620. Alternately, the terminal may have a single straight groove defined in the internal surface. Elements in the embodiment of FIG. 6 similar to elements shown and described in the embodiment of FIGS. 1-4 have reference numerals that differ by 500.

Figure 7:
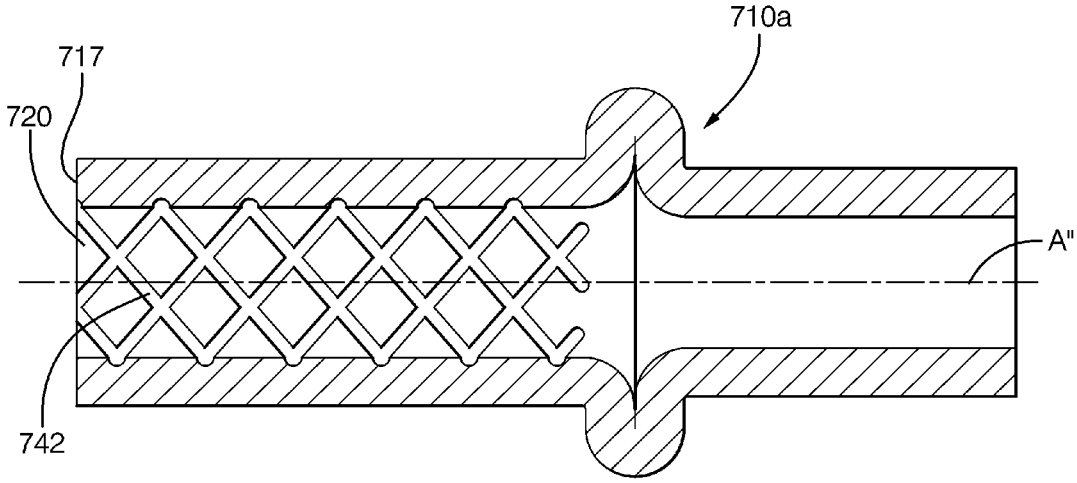
FIG. 7 shows a cross hatched groove pattern defined in a contact element according to yet another alternate embodiment of the invention.

Referring to FIG. 7, according to another embodiment of the invention, shows a cross section view of a terminal 710*a* that has a plurality of cross-hatched grooves 742 of terminal 710*a* defined in internal surface 720 along a longitudinal axis A" in a barreled portion of the terminal. A wire cable (not shown) is received at end 717 of terminal 710*a*. More specifically, terminal 710*a* is associated with pin and sleeve-type terminal system. The sleeve terminal receives the pin terminal in which these terminals may be respectively disposed in non-electrically conductive connector housings that are configured to be mated together. The pin terminal has a barreled portion that includes the groove that receives a wire cable (not shown). The sleeve terminal also has a barreled portion that receives a wire cable disposed therein. In yet another alternate embodiment, the terminal may have a single cross-hatched axial groove defined in the internal surface. Alternately, the groove disposed on the internal surface may be any type of groove that is dependent on the application of use of the pin and sleeve-type terminal system. Pin and sleeve-type terminal systems may often find use in the aerospace and military industries.

Alternately, the terminal may be plated with an electrically-enhancing plating material after the grove is formed in the terminal.

In another alternate embodiment, a plated terminal may have the groove formed in or through the plated material to a copper under layer of the terminal. In still yet another embodiment, a plated terminal may be subsequently re-plated after the construction of the groove.

Still yet alternately, the groove may be a raised groove that protrudes away from the internal surface of the tubular section.

Alternately, the terminal may have a shape that further extends away from the axis. For example, the terminal may include a right-angle bend. The tubular section may be disposed on one part of the right-angle bend and a ring-shaped tongue may be disposed on the other part of the right-angle bend.

In still other alternate embodiments, any groove shape may be defined in the internal surface. In a further alternate embodiment, the groove shape takes the form of a right-hand helical groove in combination with a left-hand helical groove disposed in the internal surface.

Still yet alternately, a through-hole may be drilled in the crimp barrel section in communication with the opening so that ease of plating the terminal is facilitated.

Thus, a robust electrical contact that attaches to a wire cable that breaks up oxides on a lead of an aluminum wire cable while decreasing the resistance and increasing the mechanical strength of the connection of the wire cable and the electrical contact. The mechanical and electrical connection between the wire cable and the electrical contact is easily attached to each other by crimping as is conventionally done in the wire connector arts. Aluminum or copper wire cables may be easily crimped to the terminal. The helical groove and the burrs at the edges of the helical groove assist to break up oxides on the wire cable, decrease the resistance of the wire cable/terminal connection and increase the mechanical strength of the crimp connection. A variety of grooves other than the helical groove may be employed in the internal surface of the electrical contact and still be within the spirit and scope of the invention. The groove is easily defined in an internal surface of the section of the electrical contact by milling, rifling, machining, and cutting using tools or machines that are known in the wiring or electrical contact art. The electrical contact with the helical groove is easily plated dependent on the application of use. The section of the electrical contact that includes the helical groove may be formed with or without a seam.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent grooves, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent grooves, the present invention being limited only by the following claims and the equivalents thereof.

We claim:

1. An electrically-conducting contact element comprising:

a section of the contact element defining an aperture configured to receive a wire cable, the aperature having an internal surface defining a groove having sharp edges configured so that when the received wire cable and the section are attached together, the sharp edges are in electrical communication with the wire cable.

2. The contact element according to claim 1, wherein said section comprises a barrel-type shape.

3. The contact element according to claim 1, wherein said groove is a crooked groove.

4. The contact element according to claim 2, wherein said groove defines a helical shape.

5. The contact element according to claim 4, wherein said crooked groove is a single helical groove.

6. The contact element according to claim 4, wherein said groove defines a right-handed helical shape and a left-handed helical shape.

7. The contact element according to claim 1, wherein said groove is at least one straight groove.

8. The contact element according to claim 1, wherein said aperture has a closed end.

9. The contact element according to claim 1, wherein the section is a circular, tubular section and said tubular section is configured to receive a wire cable formed of an aluminum alloy.

10. A wire assembly comprising:

a wire cable; and the contact element according to claim 1 receiving the wire cable and attached thereto by formation of a crimp connection.

11. A vehicular electrical wiring harness comprising:

at least one wire assembly, said at least one wire assembly including, a wire cable, and the contact element according to claim 1, wherein the contact element is attached to the wire cable by formation of a crimp connection.

* * * * *